US005425303A

United States Patent [19]

Shimizu et al.

[11] Patent Number: 5,425,303

[45] Date of Patent: Jun. 20, 1995

[54] SLANT PLATE-TYPE COMPRESSOR WITH VARIABLE DISPLACEMENT MECHANISM

[75] Inventors: Hidehiko Shimizu, Sawa; Hitoshi Azami, Maebashi; Kazuhiko Takai, Sawa, all of Japan

[73] Assignee: Sanden Corporation, Gunma, Japan

[21] Appl. No.: 208,309

[22] Filed: Mar. 10, 1994

[30] Foreign Application Priority Data

Mar. 10, 1993 [JP] Japan ..... 5-051700

[51] Int. Cl.[6] ..... F01B 3/00

[52] U.S. Cl. ..... 92/12.2; 92/71; 74/60; 417/269

[58] Field of Search ..... 92/12.2, 71, 57; 417/222.1, 269; 74/60; 91/504; 403/61, 80, 82

[56] References Cited

U.S. PATENT DOCUMENTS

| | | | |
|---|---|---|---|
| 4,175,915 | 11/1979 | Black et al. . | |
| 4,513,630 | 4/1985 | Perc et al. | 92/12.2 |
| 5,002,466 | 3/1991 | Inagaki et al. | 417/222.1 |
| 5,282,725 | 2/1994 | Shimizu . | |
| 5,316,446 | 5/1994 | Kimura et al. | 417/222.1 |

FOREIGN PATENT DOCUMENTS

| | | | |
|---|---|---|---|
| 0330965 | 9/1989 | European Pat. Off. | 417/222.1 |

*Primary Examiner*—Thomas E. Denion
*Attorney, Agent, or Firm*—Baker & Botts

[57] ABSTRACT

A slant plate type compressor with a variable displacement mechanism is disclosed. The compressor includes a compressor housing having a cylinder block provided with a plurality of cylinders and a crank chamber. A piston is slidably fitted within each of the cylinders and is reciprocated by a drive mechanism. The drive mechanism includes a drive shaft rotatably supported by the compressor housing, a cam rotor fixed on the drive shaft, and a slant plate having a surface with an adjustable incline angle. The incline angle is varied in accordance with the pressure in the crank chamber. A wobble plate is disposed adjacent the slant plate to convert the rotating motion of the drive shaft, the rotor, and the slant plate into the reciprocating motion of the pistons which are coupled to the wobble plate through corresponding connecting rods. A hinged joint mechanism hingedly connects an arm portion of the slant plate to an arm portion of the rotor to permit variations in the incline angle of the slant plate. An abrasion preventing mechanism formed of a metal is disposed between the arm portion of the cam rotor and the arm portion of the slant plate to effectively reduce abnormal abrasion on the frictional surface of the arm portion of the rotor.

38 Claims, 5 Drawing Sheets

SLANT PLATE-TYPE COMPRESSOR WITH VARIABLE DISPLACEMENT MECHANISM

BACKGROUND OF THE INVENTION

1. Field of the Invention

The present invention generally relates to refrigerant compressors and, more particularly, to a slant plate-type compressor, such as a wobble plate-type compressor, with a variable displacement mechanism suitable for use in an automotive air conditioning system.

2. Description of the Related Art

A slant plate-type refrigerant compressor with a variable displacement mechanism suitable for use in an automotive air conditioning system is disclosed in U.S. Pat. No. 4,963,074 to Sanuki et al. As disclosed therein, the compression ratio of the compressor may be controlled by changing the slant angle of the sloping surface of the wobble plate. The slant angle of the wobble plate is adjusted, so as to maintain a constant suction pressure in response to a change in the pressure differential between the suction chamber and the crank chamber.

Referring to FIG. 1, compressor 10 comprises cylinder housing assembly 20 having cylinder block 21, front end plate 23 disposed at one end of cylinder block 21, crank chamber 22 formed between cylinder block 21 and front end plate 23, and rear end plate 24 attached to the other end of cylinder block 21. Front and plate 23 is secured to one end of cylinder block 21 by a plurality of bolts 101. Rear end plate 24 is secured to the other end of cylinder block 21 by a plurality of bolts 102. Valve plate 25 is disposed between rear end plate 24 and cylinder block 21. Opening 231 is centrally formed in front end plate 23 for rotatably supporting drive shaft 26 through bearing 30 disposed therein. The rear end portion of drive shaft 26 is rotatably supported by bearing 31 disposed within central bore 210 of cylinder block 21. Bore 210 extends to a rearward (to the right in FIG. 1) end surface of cylinder block 21 and houses valve control mechanism 19.

Cam rotor 40 is fixed on drive shaft 26 by pin member 261 and rotates therewith. Thrust needle bearing 32 is disposed between the rear end surface of front end plate 23 and the adjacent axial end surface of cam rotor 40. Slant plate 50 is disposed adjacent cam rotor 40 and has opening 53 through which drive shaft 26 passes.

Referring to FIGS. 2 and 3, a hinged joint mechanism, which couples cam rotor 40 and slant plate 50, is shown. Slant plate 50 comprises arm 51 having first and second axial end surfaces 51*a* and 51*b*. Cam rotor 40 comprises arm 41 having first and second cylindrical projections 411 and 412 axially projecting from opposite end surfaces of a terminal end portion of arm 41. Hole 413 is axially bored through the terminal end portion of arm 41. Pin member 42 comprises shaft portion 42*a* and head portion 42*b* having a diameter greater than the diameter of shaft portion 42*a*. Shaft portion 42*a* of pin member 42 loosely passes through slot 52 of arm 51. Hole 413 of arm 41 of cam rotor 40 fixedly receives shaft portion 42*a* of pin member 42 by forcible insertion. Snap ring 43 is fixedly secured to one end region of shaft portion 42*a* opposite head portion 42*b*. Arm 41 of cam rotor 40, pin member 42, and slot 52 of arm 51 form a hinged joint mechanism.

Pin member 42 slides within slot 52 to allow adjustment of the angular position of slant plate 50 with respect to the longitudinal axis of drive shaft 26. Axial movement of arm 51 of slant plate 50 is limited by head portion 42*b* of pin member 42 and cylindrical projection 412 of arm 41 of rotor 40. Arm 41 of rotor 40 is typically made of cast iron. Pin member 42 and arm 51 of slant plate 50 are typically made of steel.

Referring again to FIG. 1, wobble plate 60 is rotatably mounted on slant plate 50 through bearings 61 and 62. Fork-shaped slider 63 is attached to an outer peripheral end of wobble plate 60 by pin member 64 and is slidably mounted on sliding rail 65 disposed between front end plate 23 and cylinder block 21. Fork-shaped slider 63 prevents rotation of wobble plate 60. Wobble plate 60 nutates along rail 65 when cam rotor 40 rotates. Cylinder block 21 has a plurality of peripherally-located cylinders 70 in which a plurality of pistons 71 reciprocate. Each piston 71 is coupled to wobble plate 60 by a corresponding connecting rod 72.

Rear end plate 24 comprises peripherally-positioned annular suction chamber 241 and centrally-positioned discharge chamber 251. Valve plate 25 is located between cylinder block 21 and rear end plate 24 and has a plurality of valved suction ports 242, which link suction chamber 241 with respective cylinders 70. Valve plate 25 also has a plurality of valve discharge ports 252, which link discharge chamber 251 with cylinders 70. Suction ports 242 and discharge ports 252 are provided with suitable reed valves, as described in U.S. Pat. No. 4,011,029 to Shimizu.

Suction chamber 241 comprises inlet portion 241*a*, which is connected to an evaporator (not shown) of an external cooling circuit (not shown). Discharge chamber 251 is provided with outlet portion 251*a* connected to a condenser (not shown) of the cooling circuit. Gaskets 27 and 28 are positioned between cylinder block 21 and the front end surface of valve plate 25 and the between rear end surface of valve plate 25 and rear end plate 24, respectively. Gaskets 27 and 28 seal the mating surfaces of cylinder block 21, valve plate 25, and rear end plate 24. Gaskets 27 and 28 and valve plate 25 form a valve plate assembly 200.

A first communication path which links crank chamber 22 and suction chamber 241 is formed in cylinder block 21. The first communication path comprises valve control mechanism 19, which includes cup-shaped casing 191. Casing 191 defines valve chamber 192 therein. O-ring 19*a* is disposed between an outer surface of casing 191 and an inner surface of bore 210 to seal the mating surfaces of casing 191 and cylinder block 21. A plurality of holes 19*b* are formed at the closed end (to the left in FIG. 1) of cup-shaped casing 191 to transfer crank chamber pressure into valve chamber 192 through gap 31*a*, which is located between bearing 31 and cylinder block 21. Circular plate 194 having hole 194*a* formed at the center thereof is fixed to the open end of cup-shaped casing 191. Bellows 193, which is disposed within valve chamber 192, contracts and expands longitudinally in response to the crank chamber pressure. The forward (to the left in FIG. 1) end of bellows 193 is fixed to the closed end of casing member 191. Valve member 193*a* is attached at the rearward end of bellows 193 to selectively control the opening and closing of hole 194*a*. Valve chamber 192 and suction chamber 241 are linked by hole 194*a*, central portion 211 of bore 210, conduit 195 formed in cylinder block 21, and hole 196 formed in valve plate assembly 200. Valve retainer 15 is secured to the rear end surface of valve plate assembly 200 by bolts 151.

Communication path 18, which is bored longitudinally from a forward end surface of cylinder block 21 to a rear end surface of valve retainer 15, is a second communication path formed in cylinder block 21 and links discharge chamber 251 to crank chamber 22. Communication path 18 controls the flow of refrigerant gas from discharge chamber 251 to crank chamber 22. Large diameter conduit portion 181 of communication path 18 has filter screen 182 disposed therein. Capillary tube 183, which performs a throttling function to reduce the pressure of refrigerant gas transferred from discharge chamber 251 to crank chamber 22, is fixed within communication path 18 and is coupled to filter screen 182.

During operation of compressor 10, drive shaft 26 is rotated by an automotive engine (not shown) through electromagnetic clutch 300. Cam rotor 40 is rotated with drive shaft 26 causing slant plate 50 to rotate. The rotation of slant plate 50 causes wobble plate 60 to nutate. The nutating motion of wobble plate 60 reciprocates pistons 71 in their respective cylinders 70. As pistons 71 are reciprocated, refrigerant gas which is introduced into suction chamber 241 through inlet portion 241*a* is drawn into cylinders 70 through suction ports 242 and compressed. The compressed refrigerant gas is discharged from cylinders 70 to discharge chamber 251 through respective discharge ports 252 and then into the cooling circuit (not shown) through outlet portion 251*a*. A portion of the discharged refrigerant gas in discharge chamber 251 continuously flows into crank chamber 22 through communication path 18 at a reduced pressure caused by capillary tube 183.

Valve control mechanism 19 is responsive to the pressure in crank chamber 22, which, upon exceeding a predetermined value, causes hole 194*a* to open by the contraction of bellows 193 and the resulting forward movement of valve member 193*a*. The opening of hole 194*a* permits fluid communication between crank chamber 22 and suction chamber 241. As a result, the slant angle of slant plate 50 increases to maximize the capacity of the compressor. However, when the pressure in crank chamber 22 is less than a predetermined value, hole 194*a* is closed by valve member 193*a* of bellows 193. This action blocks fluid communication between crank chamber 22 and suction chamber 241. As a result, the slant angle of slant plate 50 is controlled by changes in the pressure in crank chamber 22 to vary the displacement of compressor 10.

With respect to the hinged joint mechanism described above, an outer peripheral surface of shaft portion 42*a* of pin member 42 and an inner wall 52*a* of slot 52 of arm 51 frictionally slide against each other. Further, first axial end surface 51*a* and the axial end surface of second cylindrical projection 412 of arm 41 frictionally slide against each other. Also, second axial end surface 51*b* of arm 51 and an inner end surface of head portion 42*b* of pin member 42 frictionally slide against each other.

Because pin member 42 and arm 51 of slant plate 50 are typically made of a metal, such as steel, the frictional engagement between the outer peripheral surface of shaft portion 42*a* of pin member 42 and inner wall 53 of slot 52 of arm 51 normally occurs between two metals.

When the capacity of compressor 10 is changed, pin member 42 slides within slot 52 to allow adjustment of the angular position of slant plate 50. An outer peripheral surface 42*b* of shaft portion 42*a* of pin member 42 frictionally slides against inner wall 52*a* of slot 52 of arm 51 with a linear contact. Pin member 42 biases arm 51 of slant plate 50 toward pistons 71 against a reaction force created by the compression of refrigerant gas in cylinder 70. Therefore, both the outer peripheral surface of shaft portion 42*a* of pin member 42 and inner wall 52*a* of slot 52 are easily worn, and durability of the hinged joint mechanism between cam rotor 40 and slant plate 50 decreases abnormally.

SUMMARY OF THE INVENTION

It is an object of the invention to provide a variable capacity swash plate compressor having a slant plate and a cam rotor with a durable hinged joint mechanism therebetween.

According to the present invention, a slant plate-type compressor comprises a compressor housing enclosing a crank chamber, a suction chamber, and a discharge chamber therein. The compressor housing comprises a cylinder block having a plurality of cylinders formed therethrough. A piston slidably fits in each of the cylinders. A driving mechanism is coupled to the pistons for reciprocating the pistons within the cylinders. The driving mechanism includes a drive shaft rotatably supported in the housing, a cam rotor fixedly connected to the drive shaft, and a coupling mechanism for drivingly coupling the cam rotor to the pistons, such that rotary motion of the cam rotor is converted into reciprocating motion of the pistons.

The coupling mechanism comprises a slant plate having a surface disposed at an variable incline angle relative to a plane perpendicular to the longitudinal axis of the drive shaft. The inclination of the slant plate is adjustable to vary the capacity of the compressor. A passageway formed in the housing links the crank chamber and the suction chamber in fluid communication. A capacity control mechanism operatively associated with the passageway adjusts the capacity of the compressor by varying the inclination of the slant plate.

The above-described cam rotor is coupled to the slant plate by means of a hinged joint coupling mechanism, which comprises an abrasion reducing means for reducing abrasion on the frictional contact surfaces of the cam motor and the slant plate.

Other objects, advantages, and features will be apparent when the detailed description of the inventions and the drawings are considered.

DETAILED DESCRIPTION OF THE DRAWINGS

Figure 1:
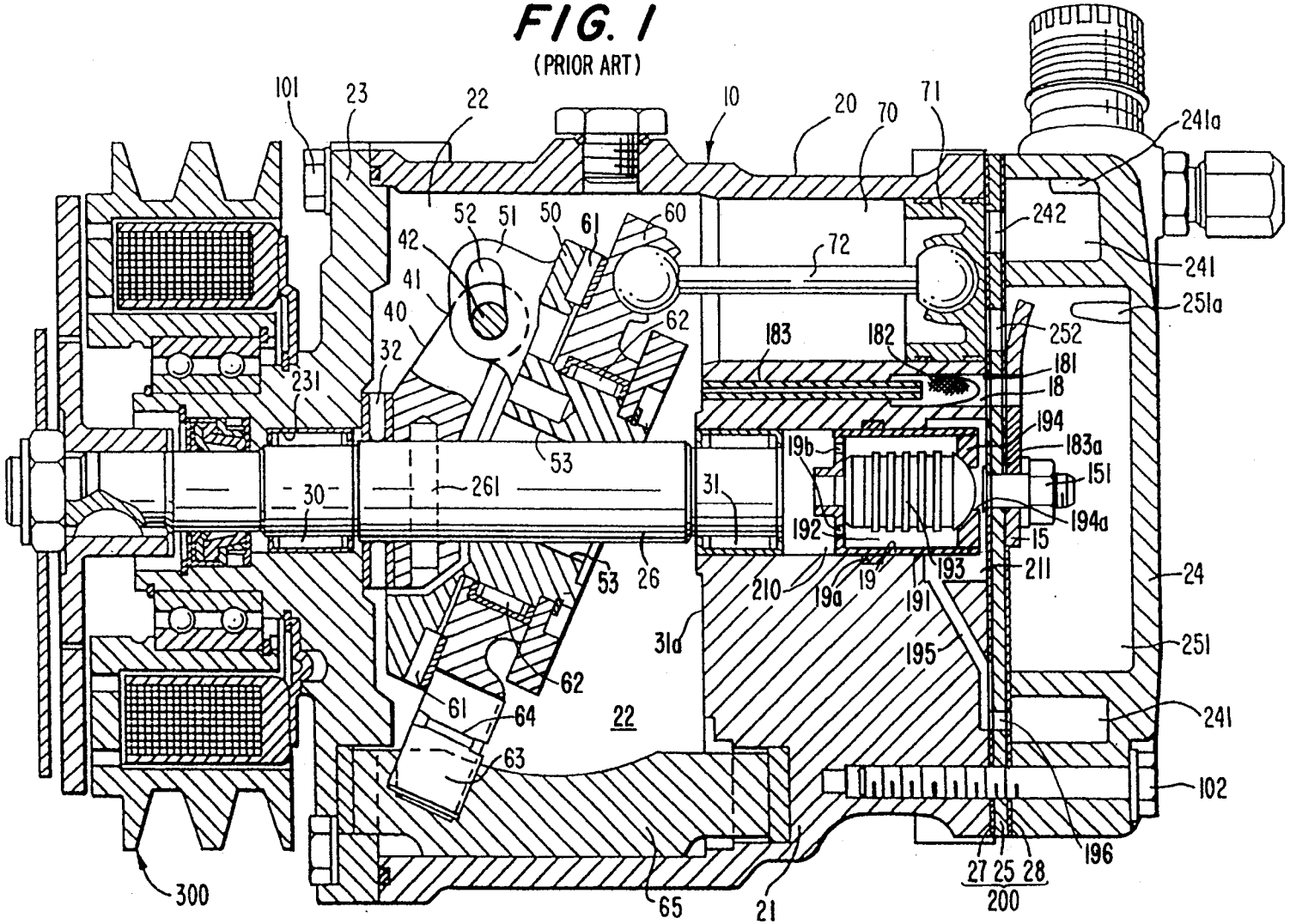
FIG. 1 (PRIOR ART)
FIG. 1 is a longitudinal sectional view of a swash plate refrigerant compressor with a variable displacement mechanism in accordance with the prior art.
Figure 2:
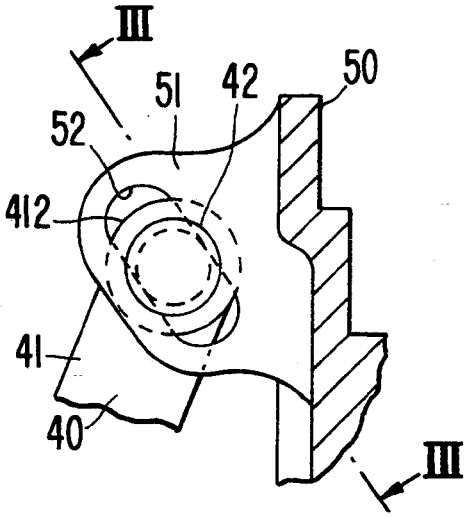
FIG. 2 (PRIOR ART)
FIG. 2 is an illustrative side view of a hinged joint coupling mechanism in accordance with the compressor of FIG. 1.
Figure 3:
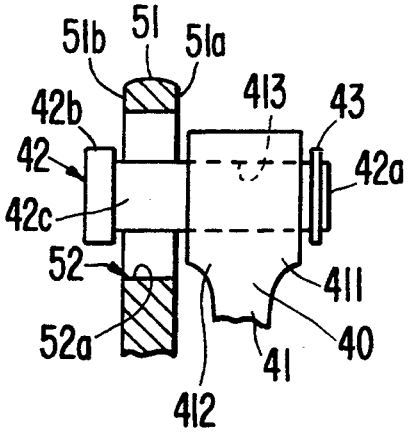
FIG. 3 (PRIOR ART)
FIG. 3 is an illustrative front view of a hinged joint coupling mechanism taken along line III—III in FIG. 2.

In FIGS. 4–8, certain elements are designated by the same numerals that are used to denote corresponding elements shown in FIG. 1. Also, further explanation of previously described elements is omitted for convenience.

Figure 4:
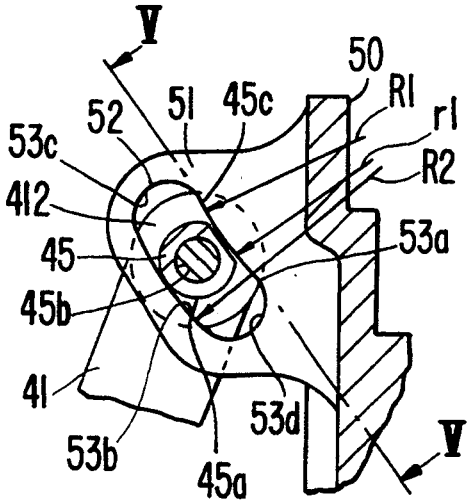
FIG. 4 is an illustrative side view of a hinged joint coupling mechanism according to a first embodiment of the present invention.
Figure 5:
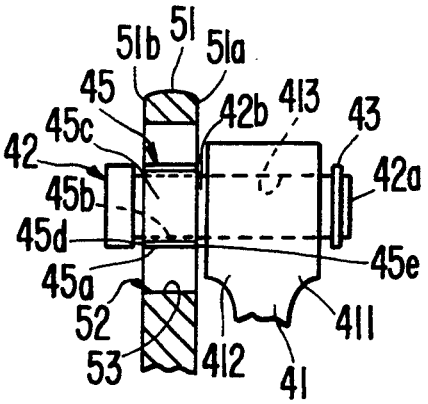
FIG. 5 is an illustrative front view of a hinged joint coupling mechanism taken along line V—V in FIG. 4.

FIGS. 4 and 5 illustrate a portion of a hinged joint coupling mechanism for a wobble plate-type refrigerant compressor with a variable displacement mechanism in accordance with a first embodiment of the present invention. Cylindrical collar 45 includes hole 45*b* formed in the radial center thereof and is mounted, e.g., by forcible insertion, about shaft portion 42*a* of pin member 42. Cylindrical collar 45 and shaft portion 42*a* of pin member 42 are loosely received through elongated slot 52 formed in arm 51 of slant plate 50. Further, cylindrical collar 45 includes curved surface portion 45*c* formed on outer surface portion 45*a* of collar 45. Curved surface portion 45*c* radially extends partially about an outer circumference of collar 45 and extends axially from first axial end 45*d* of collar 45 to second axial end 45*e* of collar 45.

Cylindrical collar 45 is preferably made of steel, bronze, or a white metal. Elongated slot 52 of arm 51 has inner wall 53 which comprises four arc-shaped wall portions, i.e., first wall portion 53*a*; second wall portion 53*b*; third wall portion 53*c*; and fourth wall portion 53*d*. Preferably, third and fourth wall portions 53*c* and 53*d* are shorter than first and second wall portions 53*a* and 53*b*. Thus, the wall portions cooperate to form elongated slot 52.

Radial cross sections of first and second wall portions 53*a* and 53*b* are designed to have respective radii of curvature R1 and R2, so as to gradually increase the capacity of compressor from a minimum capacity to a maximum with a non-linear change in the angle of the slant plate. The centers of radii of curvature R1 and R2 are preferably located rearward from the axis of pin member 42 (i.e., generally toward cylinders 70). The radial cross sections of first and second wall portions 53*a* and 53*b* are formed to be concentric With each other. Further, second and third wall portions 53*c* and 53*d* preferably have the same radius of curvature.

A radial cross section of curved surface portion 45*c* is arc-shaped and has a radius of curvature r1. Radius of curvature r1 is preferably designed to be equal to or slightly greater than radius of curvature R1. During normal operation of the compressor, excluding starting, pin member 42 continuously biases arm 51 of slant plate 50 toward pistons 71 against the reaction force created by the compressing refrigerant in cylinders 70. Therefore, cylindrical collar 45 constantly and slidably contacts with only first wall portion 53*a* during normal operation of the compressor. Preferably, the surface area of curved surface portion 45*c* is maximized. The contact between first wall portion 53*a* and curved surface portion 45*c* results in a contact force. A larger surface area of portion 45*c* reduces the contact force per unit area.

According to a feature of this embodiment, pin member 42 does not contact directly with inner wall 53 of elongated slot 52. Rather, cylindrical collar 45 slidably contacts inner wall 53. Also, the curved surfaces of portion 45*c* and first wall portion 53*a* preferably allow curved surface portion 45*c* of cylindrical collar 45 to smoothly slide non-linearly along inner wall 53 of elongated slot 52 without rotating relative to first wall portion 53*a*. Accordingly, abrasion between inner wall 53 of slot 52 and cylindrical collar 45 is effectively reduced. This represents a technical advantage over the prior art.

Figure 6:
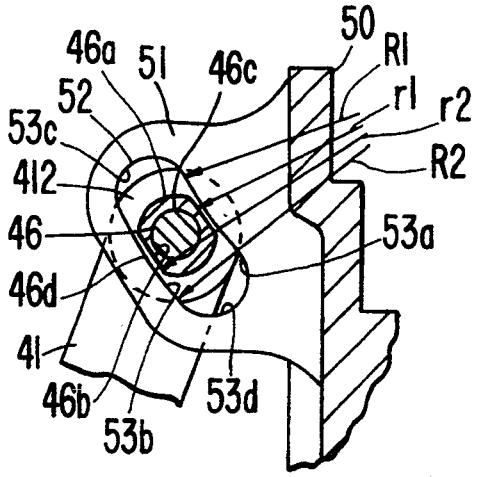
FIG. 6 is an illustrative front view of a hinged joint coupling mechanism according to a second embodiment of the present invention.

FIG. 6 illustrates a second embodiment of the present invention. Cylindrical collar 46 comprises first curved surface portion 46*c* and second curved surface portion 46*d*, which are formed opposite each other on outer surface 46*a* and are similar to curved surface portion 45*c* of the first embodiment. First curved surface portion 46*c* and second curved surface portion 46*d* have radial cross sections which are arc-shaped and have respective radii of curvature r1 and r2. Radius of curvature r2 is preferably designed to be equal to or slightly less than radius of curvature R2, whereas radius of curvature r1 is preferably designed to be equal to or slightly greater than radius of curvature R1.

Similar to the first embodiment of the present invention as described above, pin member 42 does not contact directly with inner wall 53 of elongated slot 52. Rather, cylindrical collar 46 slidably contacts with inner wall 53. Also, the curved surfaces of first curved surface portion 46*c* and first wall portion 53*a* and the curved surfaces of second curved surface portion 46*d* and second wall portion 53*b* preferably allow curved surface portion 46*a* of cylindrical collar 46 to smoothly slide, non-linearly, along inner wall 53 of elongated slot 52 without rotating relative to first and second wall portion 53*a* and 53*b*. Accordingly, abrasion between inner wall 53 of slot 52 and cylindrical collar 46 can be effectively reduced, not only during normal operation of the compressor, but also during starting and abnormal operation of the compressor. The materials for cylindrical collar 46 are preferably as described for cylindrical collar 45 in the first embodiment.

Figure 7:
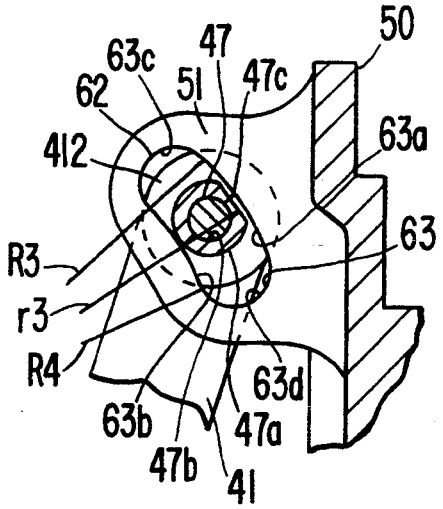
FIG. 7 is an illustrative front view of a hinged joint coupling mechanism according to a third embodiment of the present invention.

FIG. 7 illustrates a third embodiment of the present invention. Cylindrical collar 47 includes curved surface portion 47*c* formed on outer surface portion 47*a* in a manner similar to curved surface portion 45*c* of the first embodiment and first and second curved surface portions 46*c* and 46*d* of the second embodiment. Elongated slot 62 of arm 51 has inner wall 63, which comprises four arc-shaped wall portions, i.e., first wall portion 63*a*; second wall portion 63*b*; third wall portion 63*c*; and fourth wall portion 63*d*.

Radial cross sections of first and second wall portions 63*a* and 63*b* are preferably designed to have respective radii of curvature R3 and R4 to allow a rapid increase in the capacity of compressor from minimum to maximum capacity with a non-linear change in the angle of the slant plate. Because of the orientation of elongated slot 62, the non-linear change in the angle of the slant plate is different from that described in connection with the first and second embodiments.

The centers of radii of curvature R3 and R4 are preferably located forward from the axis of pin member 42 (i.e., generally away from cylinders 70). First and second wall portions 63*a* and 63*b* are formed to be concentric with each other. Further, third and fourth wall portions 63*c* and 63*d* preferably have the same radius of curvature. The radial cross section of curved surface portion 47*c* of cylindrical collar 47 is arc-shaped and has a radius of curvature r3. Radius of curvature r3 is preferably designed to be equal to or slightly less than radius of curvature R3.

The materials for cylindrical collar 47 are preferably as described for cylindrical collars 45 and 46 in the first and second embodiments, respectively. Further, the advantages and features of the hinged joint coupling mechanism according to this embodiment are the same as those discussed in connection with the first embodiment. For convenience, the description of these features and advantages will not be repeated.

Figure 8:
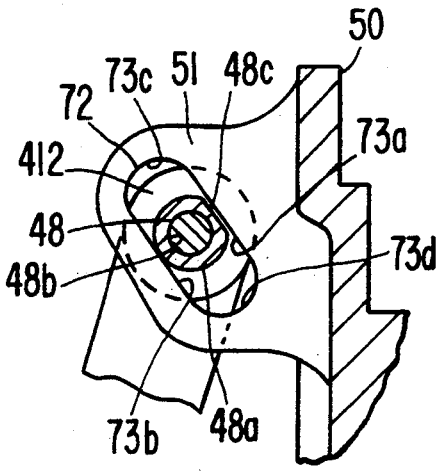
FIG. 8 is an illustrative front view of a hinged joint coupling mechanism according to a fourth embodiment of the present invention.

FIG. 8 illustrates a fourth embodiment of the present invention. Cylindrical collar 48 includes flat surface portion 48*c* formed on outer surface portion 48*a*. Portion 48*c* preferably extends from a first radial end of collar 48 to a second radial end of collar 48. Elongated slot 72 of arm 51 has inner wall 73, which comprises two linear-shaped, i.e., first wall portion 73*a*; second wall portion 73*b*, and two arc-shaped portions, i.e., third wall portion 73*c*; and fourth wall portion 73*d*. First and second wall portions 73*a* and 73*b* are preferably designed to have the same length, so as to increase the capacity of the compressor from the minimum to the maximum linearly, as opposed to the increases described in the previous embodiments. Third and fourth wall portions 73*c* and 73*d* preferably have the same radius of curvature. The radial cross section of flat surface portion 48*c* of cylindrical collar 48 is linear.

Preferably, the surface area of curved surface portion 48*c* is maximized. The contact between first wall portion 73*a* and flat surface portion 48*c* results in a frictional force. A larger surface area of portion 48*c* reduces the frictional per unit area. Therefore, given this configuration of elongated slot 72, this fourth embodiment functions similarly to the slot 45 in the first embodiment.

According to the features of each of the above-described embodiments, the invention results in a variable displacement compressor which produces less vibration and noise than prior art compressors, thus increasing the comfort of a passenger in an automotive vehicle in which the compressor is operating. Further, the reliability of the variable displacement compressor may be enhanced, particularly during high speed operation.

Although the present invention has been described in connection with the preferred embodiments, the invention is not limited thereto. It will be easily understood by those having ordinary skill in the art that variations and modifications can be easily made within the scope of the present invention, as defined by the appended claims.

We claim:

1. A slant plate compressor comprising:

a compressor housing having a cylinder block including a plurality of cylinders and a crank chamber adjacent to said cylinder block;

a drive shaft rotatably supported in said compressor housing;

a cam rotor fixed on said drive shaft and connected to a slant plate by means of a hinged joint mechanism for varying the inclination of said slant plate with respect to said drive shaft, said hinged joint mechanism comprising:

a first arm portion extending from said cam rotor;

a second arm portion extending from said slant plate, said second arm portion including an elongated slot through which passes a pin member fixedly connected to said first arm portion; and an abrasion reducing means loosely mounted about said pin member and loosely received in said elongated slot for reducing abrasion of contact surfaces between said cam rotor, said pin member and said slant plate, said abrasion reducing means including at least one surface portion slidably contacting a surface of said elongated slot, such that said abrasion reducing means is prevented from rotating completely about said pin member;

a wobble plate adjacent to said slant plate for converting rotational motion of said slant plate into nutating motion of said wobble plate;

a plurality of pistons coupled to said wobble plate, each piston reciprocally fitted within one of said cylinders, whereby a stroke volume is changed in accordance with the varying inclination of said slant plate;

a passageway formed in said housing and placing said crank chamber and said suction chamber in fluid communication; and capacity control means coupled to said passageway for adjusting a capacity of said compressor by varying the inclination of said slant plate.

2. The slant plate compressor of claim 1, wherein said abrasion reducing means is an annular cylindrical member.

3. A slant plate-type compressor comprising:

a compressor housing having a cylinder block including a plurality of cylinders and a crank chamber adjacent to said cylinder block;

a drive shaft rotatably supported in said housing;

a cam rotor fixed on said drive shaft and connected to a slant plate by means of a hinged joint mechanism for varying the inclination of said slant plate with respect to said drive shaft, said hinged joint mechanism comprising:

a first arm portion extending from said cam rotor;

a second arm portion extending from said slant plate, said second arm portion including an elongated slot through which passes a pin member fixedly connected to said first portion, said elongated slot defined by a radial inner wall having a first long wall portion on a side of said elongated slot nearest said cylinders, a second long wall portion opposite said first long wall portion, and a pair of short wall portions linking said first long wall portion and said second long wall portion, said first long wall portion and said second long each having a radius of curvature and being concentric with each other, so as to non-linearly increase a capacity of said compressor from minimum to maximum, the center of said radius of curvature for both said first long wall portion and said second long wall portion being on said cylinder side; and an abrasion reducing means loosely mounted about said pin member and loosely received in said elongated slot for reducing abrasion of contact surfaces between said cam rotor, said pin member and said slant plate, said abrasion reducing means including at least one surface portion formed on a peripheral surface thereof, said at least one surface portion slidably contacting a surface of said radial inner wall, such that said abrasion reducing means is prevented from rotating completely about said pin member;

a wobble plate adjacent to said slant plate for converting rotational motion of said slant plate into nutating motion of said wobble plate;

a plurality of pistons coupled to said wobble plate, each piston reciprocally fitted within one of said cylinders, whereby a stroke volume is changed in accordance with the varying inclination of said slant plate;

a passageway formed in said housing and placing said crank chamber and said suction chamber in fluid communication; and capacity control means coupled to said passageway for adjusting a capacity of said compressor by varying the inclination of said slant plate.

4. The slant plate-type compressor of claim 3 wherein said at least one surface portion of said abrasion reducing means includes a radial section formed as a curved line having a single radius of curvature.

5. The slant plate-type compressor of claim 4 wherein said single radius of curvature is about equal to said radius of curvature of said first long wall portion.

6. The slant plate-type compressor of claim 4, wherein said single radius of curvature is less than said radius of curvature of said first long wall portion.

7. The slant plate-type compressor of claim 3, wherein said abrasion reducing means is an annular cylindrical member.

8. The slant plate-type compressor of claim 7, wherein said at least one surface portion of said cylindrical member includes a radial section which is a curved line having a single radius of curvature.

9. The slant plate-type compressor of claim 8, wherein said single radius is about equal to said radius of curvature of said first long wall portion.

10. The slant plate-type compressor of claim 8, wherein said single radius is greater than said radius of curvature of said first long wall portion.

11. The slant plate-type compressor of claim 7, wherein said at least one surface portion of said cylindrical member comprises a pair of surface portions formed on opposite sides of said cylindrical member.

12. The slant plate-type compressor of claim 11, wherein each of said pair of surface portions includes a radial section which is a curved line having a single radius of curvature, such that said single radii are about equal to said radius of curvature of said first long wall portion, and said second long wall portion respectively.

13. The slant plate-type compressor of claim 11, wherein each of said pair of surface portions includes a radial section which is a curved line having a single radius of curvature, such that each of said single radii is greater than each of said radii of curvature of said first long wall portion and said second long wall portion respectively.

14. A slant plate-type compressor comprising:

a compressor housing having a cylinder block including a plurality of cylinders and a crank chamber adjacent to said cylinder block;

a drive shaft rotatably supported in said compressor housing;

a cam rotor fixed on said drive shaft and connected to a slant plate by means of a hinged joint mechanism for varying the inclination of said slant plate with respect to said drive shaft, said hinged joint mechanism comprising:

a first arm portion extending from said cam rotor;

a second arm portion extending from said slant plate, said second arm portion including an elongated slot through which passes a pin member fixedly connected to said first portion, said elongated slot defined by a radial inner wall having a first long wall portion on a side of said elongated slot nearest said cylinders, a second long wall portion, on a side opposite said first long wall portion, and a pair of short wall portions linking said first long wall portion and said second long wall portion, said first long wall portion and said second long wall portion each having a radius of curvature and being concentric with each other, so as to non-linearly increase a capacity of said compressor from minimum to maximum, each of said radii of curvature of said first long wall portion and second long wall portion having a center of curvature opposite said cylinder side; and an abrasion reducing means loosely mounted about said pin member and loosely received in said elongated slot for reducing abrasion of contact surfaces between said cam rotor and said slant plate, said abrasion reducing means including at least one surface portion formed on a peripheral surface thereof, said surface portion slidably contacting a surface of said radial inner wall of said elongated slot, such that said abrasion reducing means is prevented from rotating completely about said pin member;

a wobble plate adjacent to said slant plate for converting rotational motion of said slant plate into nutating motion of said wobble plate;

a plurality of pistons coupled to said wobble plate, each piston reciprocally fitted within one of said cylinders, whereby a stroke volume is changed in accordance with the varying inclination of said slant plate;

a passageway formed in said housing and placing said crank chamber and said suction chamber in fluid communication; and capacity control means coupled to said passageway for adjusting a capacity of said compressor by varying the inclination of said slant plate.

15. The slant plate-type compressor of claim 14 wherein said at least one surface portion of said abrasion reducing means includes a radial section which is formed as a curved line having a single radius of curvature.

16. The slant plate-type compressor of claim 15 wherein said single radius of curvature is about equal to said radius of curvature of said first long wall portion.

17. The slant plate-type compressor of claim 15, wherein said single radius of curvature is less than said radius of curvature of said first long wall portion.

18. The slant plate-type compressor of claim 14, wherein said abrasion reducing means is an annular cylindrical member.

19. The slant plate-type compressor of claim 18, wherein said at least one surface portion of said cylindrical member includes a radial section which is a curved line having a single radius of curvature.

20. The slant plate-type compressor of claim 19, wherein said single radius of curvature about equal to said radius of curvature of said first long wall portion.

21. The slant plate-type compressor of claim 19 wherein said single radius of curvature is less than said radius of curvature of said first long wall portion.

22. The slant plate-type compressor of claim 18, wherein said at least one surface portion of said cylindrical member comprises a pair of surface portions formed on opposite sides of said cylindrical member.

23. The slant plate type compressor of claim 22, wherein each of said pair of surface portions includes a radial section which is a curved line having a single radius of curvature, such that said single radii are about equal to said radii of curvature of said first long wall portion and said second long wall portion, respectively.

24. The slant plate-type compressor of claim 22, wherein each of said pair of surface portions includes a radial section which is a curved line having a single radius of curvature, such that said single radii are less than said radii of curvature of said first long wall portion and said second long wall portion, respectively.

25. A slant plate-type compressor comprising:

a compressor housing having a cylinder block including with a plurality of cylinders and crank chamber adjacent to said cylinder block;

a drive shaft rotatably supported in said compressor housing;

a cam rotor fixed on said drive shaft and connected to a slant plate by means of a hinged joint mechanism for varying the inclination of said slant plate with respect to said drive shaft, said hinged joint mechanism comprising:

a first arm portion extending from said cam rotor;

a second arm portion extending from said slant plate, said second arm portion including an elongated slot through which passes a pin member fixedly connected to said first portion, said elongated slot defined by a radial inner wall having a pair of straight long wall portions on opposite sides and a pair of short wall portions linking said pair of straight long wall portions, so as to linearly increase a capacity of said compressor from minimum to maximum; and an abrasion reducing means loosely mounted about said pin member and loosely received in said elongated slot for reducing abrasion of contact surfaces between said cam rotor, said pin member and said slant plate, said abrasion reducing means including at least one surface portion formed on a peripheral surface thereof, said at least one surface portion slidably contacting a surface of said radial inner wall, such that said abrasion reducing means is prevented from rotating completely about said pin member;

a wobble plate adjacent to said slant plate for converting rotational motion of said slant plate into nutating motion of said wobble plate;

a plurality of pistons coupled to said wobble plate, each piston being reciprocally fitted within one said of cylinders, whereby a stroke volume is changed in accordance with the varying inclination of said slant plate;

a passageway formed in said housing and placing said crank chamber and said suction chamber in fluid communication; and capacity control means coupled to said passageway for adjusting a capacity of a compressor by varying the inclination of said slant plate.

26. The slant plate-type compressor of claim 25, wherein said at least one surface portion of said abrasion reducing means includes a radial section which is a straight line.

27. The slant plate-type compressor of claim 25, wherein said at least one surface portion of said abrasion reducing means is a pair of surface portions formed opposite each other on a peripheral surface of said abrasion reducing means.

28. The slant plate-type compressor of claim 27, wherein said pair of surface portions of said abrasion reducing means include radial sections which are straight lines.

29. The slant plate-type compressor of claim 25, wherein said abrasion reducing means is an annular cylindrical member.

30. The slant plate-type compressor of claim 29, wherein said at least one surface portion of said cylindrical member includes a radial section which is a straight line.

31. The slant plate-type compressor of claim 29, wherein said at least one surface portion of said cylindrical member is a pair of surface portions formed opposite each other on a peripheral surface of said cylindrical member.

32. The slant plate-type compressor of claim 31, wherein said pair of surface portions of said cylindrical member include radial sections which are straight lines.

33. A hinged joint mechanism for joining a slant plate and a cam rotor in a slant plate-type compressor, wherein an elongated slot having an inner wall is formed in one of the cam rotor and the slant plate, and wherein a pin member penetrates the elongated slot and is fixedly connected to the other of the cam rotor and the slant plate, said hinged joint mechanism comprising:

an abrasion reducing member loosely mounted about the pin member and loosely received in the elongated slot for reducing abrasion of contact surfaces between said pin member, the cam rotor and the slant plate, said abrasion reducing member including at least one surface portion formed on a peripheral surface thereof, said at least one surface portion slidably contacting a surface of the inner wall, such that said abrasion reducing mechanism is prevented from rotating completely about said pin member.

34. The hinged joint mechanism of claim 33, said at least one surface portion of said abrasion reducing member including a radial section formed as a curved line having a single radius of curvature.

35. The hinged joint mechanism of claim 34 wherein the surface of the inner wall has at least one long wall portion having a radius of curvature, the single radius of curvature being about equal to the radius of curvature of the at least one long wall portion.

36. The hinged joint mechanism of claim 34 wherein the surface of the inner wall has at least one long wall portion having a radius of curvature, the single radius of curvature being less than the radius of curvature of the at least one long wall portion.

37. The hinged joint mechanism of claim 34 wherein the surface of the inner wall has at least one long wall portion having a radius of curvature, the single radius of curvature being greater than the radius of curvature of the at least one long wall portion.

38. The hinged joint mechanism of claim 33, said abrasion reducing member being formed as an annular cylindrical member.

* * * * *